US005957024A

United States Patent [19]

Kuwabara

[11] Patent Number: 5,957,024

[45] **Date of Patent: *Sep. 28, 1999**

[54] PIERCING APPARATUS FOR LINING MATERIAL

[75] Inventor: Akira Kuwabara, Ayase, Japan

[73] Assignee: Ikeda Bussan Co., Ltd., Ayase, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/529,323

[22] Filed: Sep. 18, 1995

[30] Foreign Application Priority Data

Sep. 28, 1994 [JP] Japan ..... 6-258702

[51] Int. Cl.[6] ..... B26F 1/02

[52] U.S. Cl. ..... 83/685; 83/686; 83/687; 83/688; 83/689

[58] Field of Search ..... 83/685, 686, 687, 83/688, 689, 691, 693, 694

[56] References Cited

U.S. PATENT DOCUMENTS 1,874,036 8/1932 Gray ..... 83/688

2,006,889 7/1935 Frommherz ..... 83/685 X 3,847,049 11/1974 Bitzel ..... 83/693 X

*Primary Examiner*—M. Rachuba

*Attorney, Agent, or Firm*—Foley & Lardner

[57] ABSTRACT

A piercing apparatus for forming partially overlapped small holes in upper and lower layers of lining material includes upper and lower piercing stands having piercing members affixed thereto respectively. The upper and lower piercing members have engaging cut-out portions corresponding to a shape of the overlap desired between the holes. When holes are formed for a first layer of lining material, the material is positioned between upper and lower stands mounting the piecing members and the lower piercing member is driven up to cut-out the shape of the opening for the first layer except for the overlap area. Then as the lower piercing member is driven up further, the leading edge of its cut-out portion engages the trailing edge of the corresponding cut-out portion of the upper piercing member. At this time the shape of the overlap portion is cut from the first layer of lining material. When the openings for the second layer of lining material are to be formed, the above operation is reversed and the opening may be shaped and positioned with a single apparatus.

9 Claims, 4 Drawing Sheets

PIERCING APPARATUS FOR LINING MATERIAL

BACKGROUND OF THE INVENTION

1. Field of the Invention

The present invention relates generally to a piercing apparatus. Specifically, the invention relates to a piercing apparatus for a lining material, which for example, is to be aligned with an overlying or underlying material.

2. Description of the Related Art

Referring to FIGS. 6 and 7, a piercing operation according to the related art will be described in detail in relation to an installation operation for ceiling material in an automotive interior, which operation is used for example only.

As may be seen in the drawings, layers of ceiling lining material 1 (1*a*, 1*b*) are pierced to produce small openings 3*a*, 3*b*, which may be utilized for the mounting of a sun-visor, or other vehicle interior accessory. When the layers of lining material 1*a*, 1*b* are overlaid for installation in the vehicle, a certain degree of overlap is present between the small opening 3*a* and the small opening 3*b*. Conventionally, to carry out such a piercing operation, an apparatus including at least two piercing members (blades, needles, or the like) must be utilized.

However, for providing piercing of identical shape to two layers of lining material for an automotive ceiling according to the conventional art, strict positional alignment of the small holes 3(*a*), 3(*b*) formed by the piercing apparatus is subject to slight variation or distortion in the shape of the holes, or alternatively, strict uniformity of shape is subject to a certain amount of positional slip, or variation. If piercing of uniform size and shape are desired to be formed in a multi-layer lining material with such an overlap, at least two piercing members must be utilized and the overall costs of processing are increased.

Further, when piercing is carried out for each layer of lining material, additional processing must be carried out for removal of a cut-out portion of the material and processing complexity is increased. In addition, according to the above, the overall speed of piercing processing will be reduced. Also, during alignment of materials subject to separate processing, a certain amount of slip is likely to occur and overall accuracy is reduced, particularly with respect to the necessary overlap portion of the small openings 3(*a*) and 3(*b*).

Thus, it has been required to provide a piercing apparatus which is low in cost, accurate in operation, and which can perform piercing operations at a high rate of speed with simple structure.

Also, it is desirable to provide a piercing apparatus capable of simultaneously carrying out piercing of materials along with removal of a cut-out portion thereof.

In addition, it is highly advantageous to provide a single piercing arrangement which is effective for carrying out piercing processing for forming both upper and lower small holes without slippage or distortion of either position or shape of the formed openings.

SUMMARY OF THE INVENTION

It is therefore a principal object of the present invention to overcome the drawbacks of the related art.

It is a further object of the present invention to provide a piercing apparatus which is low in cost, accurate in operation, and which can perform piercing operations at a high rate of speed with a simple structure.

It is a further object of the present invention to provide a piercing apparatus which can simultaneously carry out piercing of materials and removal of a cut-out portion thereof.

It is also an object of the invention to provide a single piercing arrangement which is effective for carrying out piercing processing for forming both upper and lower small holes without slippage or distortion of either position or shape of the formed openings.

In order to accomplish the aforementioned and other objects, there is provided a piercing apparatus for respectively piercing layers of a lining material such that an overlap of predetermined shape is defined between respective first holes formed in a first layer of the lining material and second holes formed in a different layer of the lining material. A layer of the lining material to be pierced is set between vertically spaced lower and upper piercing stands, comprising a piercing assembly including vertically opposed lower and upper piercing members having first and second cross-sections which respectively include first and second axially aligned overlapped areas having a shape corresponding to the shape of the overlap. The lower and upper piercing members respectively are mounted on the lower and upper piercing stands such that facing ends thereof are vertically spaced apart. The lower piercing member includes an axially extending groove defining the first overlapped area and the upper piercing member includes an axially extending cut-out defining the second overlapped area, and at least one of the lower and upper piercing members are axially movable relative to the other so as to effect piercing of the layer of lining material by a selected one of the upper or lower piercing members for forming the first or second holes. The groove receives the cut-out so as to cut an edge of the hole bordering the overlap at a time later than that at which cutting of other edge portions of the hole is carried out.

According to another aspect of the invention, there is provided a piercing apparatus for piercing a plurality of layers of lining material wherein an overlap of predetermined dimensions is to be provided between shaped holes formed in a first layer of the lining material and shaped holes formed in a second layer of the lining material, comprising first and second piercing stands spaced opposed to each other such that a layer of the lining material may be disposed therebetween. A first vertical piercing member defines a shape of a first opening to be formed in a first layer of the lining material and mounted on the first piercing stand. A second vertical piercing member mounted on the second piercing stand defines a shape of a second opening to be formed in a second layer of the lining material. The second piercing member is spaced opposed to the first vertical piercing member, wherein a portion of the peripheral area of the first piercing member corresponding to a shape of the overlap is axially aligned with a portion of the peripheral area of the second piercing member which also corresponds to the shape of the overlap. A concave axial groove is formed in an end of the first piercing member at the peripheral portion corresponding to the overlap and having a horizontal cross-section defining the shape of the overlap, the concave axial groove having a leading edge at a distal end of the first piercing member and a trailing edge at a terminus of the concave axial groove. A cut-out portion is formed in an end of the second piercing member at the peripheral portion corresponding to the overlap, a horizontal cross-section of the cut-out portion corresponding to the shape of the overlap, the cut-out portion further having a leading edge at a distal end of the second piercing member and a trailing edge at a terminus of the cut-out portion. The first and second piercing members are axially movable relative to each other such that the concave axial groove of the first piercing member receives the cut-out portion of the second piercing member in a manner so as to effect piercing operation whereby the layer of lining material may be selectively pierced by one of the first or second piercing members such that an edge of the shaped hole which borders the overlap is cut at a later time than other edges of the shaped hole.

BRIEF DESCRIPTION OF TEE DRAWINGS

In the drawings:

FIG. 2(*b*) is a perspective view of a lower piercing member compatible with that of FIG. 2;

DESCRIPTION OF THE PREFERRED EMBODIMENT

Referring to the accompanying drawings, a preferred embodiment of the invention will be described hereinbelow in detail.

Figure 3:
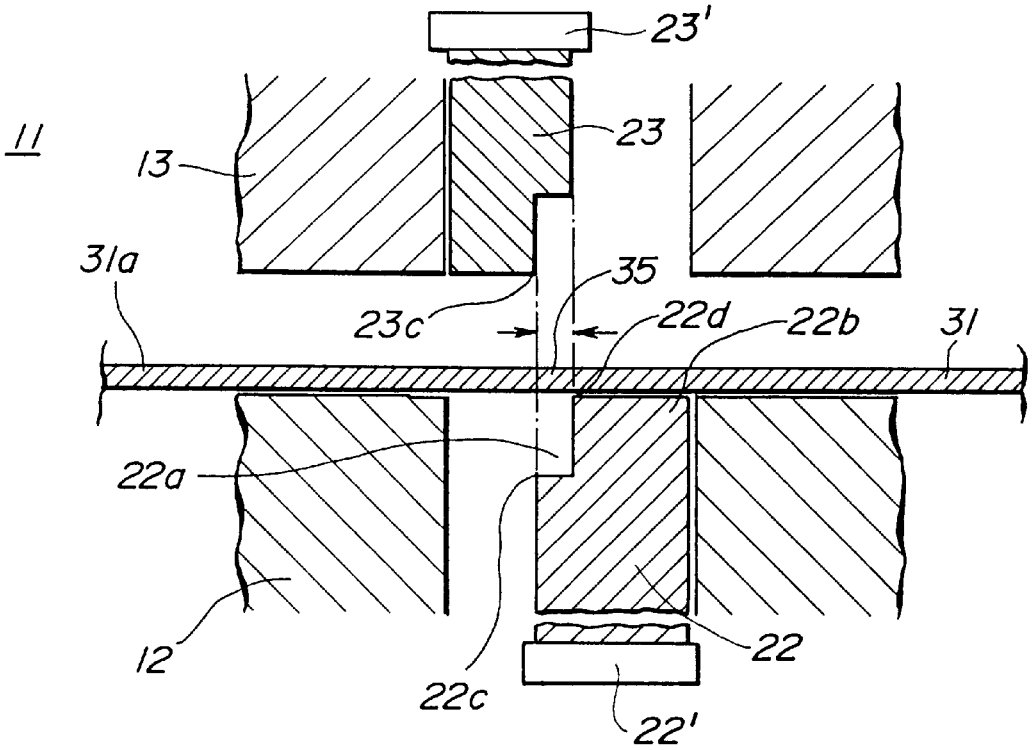
FIG. 3 is a vertical cross-sectional view of a layer of lining material arranged in the apparatus of the invention prior to carrying out of piercing operation.
Figure 5:
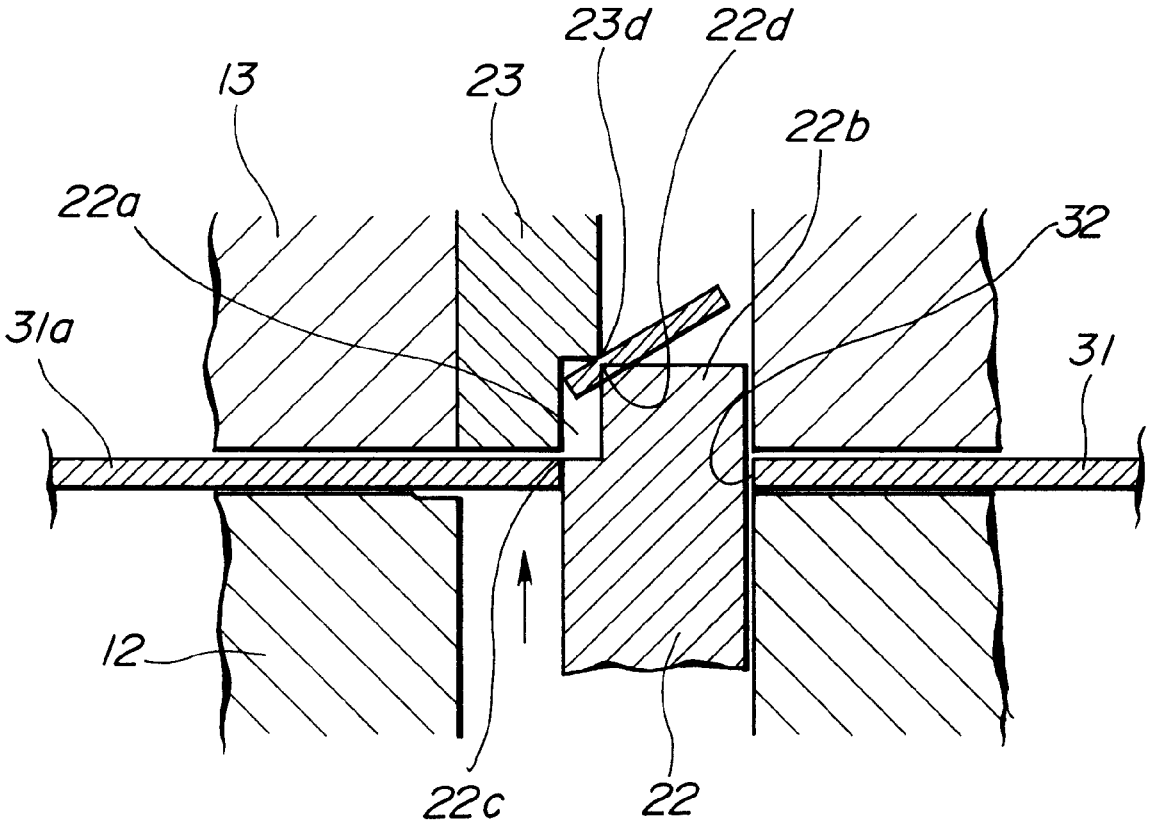
FIG. 5 shows the material arranged in the apparatus of FIGS. 3 and 4 at completion of the piercing operation.
Figure 6:
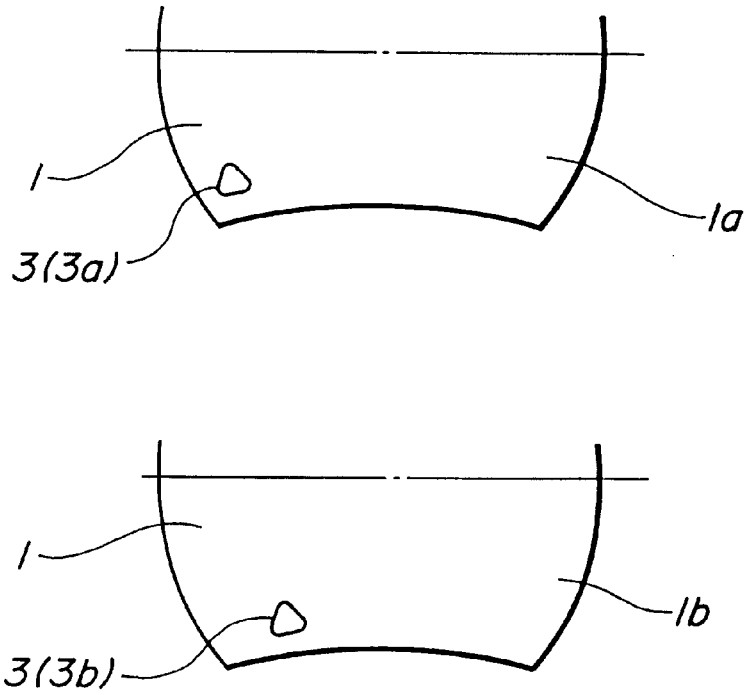
FIG.6 PRIOR ART
FIGS. 6 and 7 are illustrative of conventional piercing operations for lining materials according to the related art.
Figure 7:
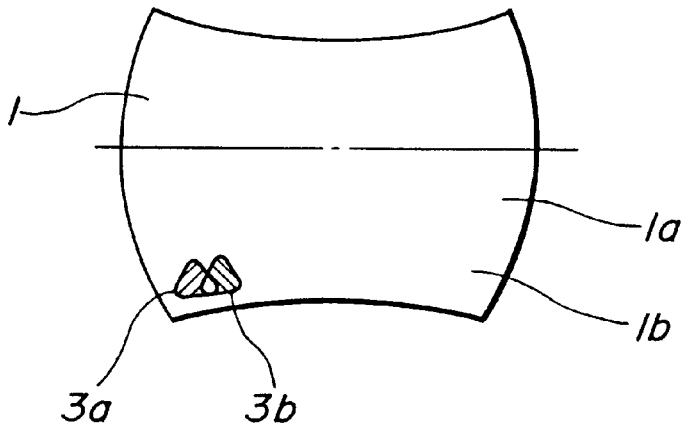
FIG.7 PRIOR ART

As may be seen in FIGS. 3 and 5, a piercing apparatus 11 includes a lower piercing stand 12, an upper piercing stand 13 which are opposed to each other and mounted such that piercing members 22, 23 of one or both stands are freely movable on a common (eg. vertical) axis. Driving mechanisms 22',23' are connected to piercing members 22,23, respectively, such that driving mechanisms 22',23' drive piercing members 22,23. According to the present embodiment, the upper piercing stand 13 is vertically movable with respect to the lower piercing stand 12 while the lower piercing member 22 of the lower stand 12 is vertically movable relative to the upper piercing member 23 of the upper stand 13.

Figure 1:
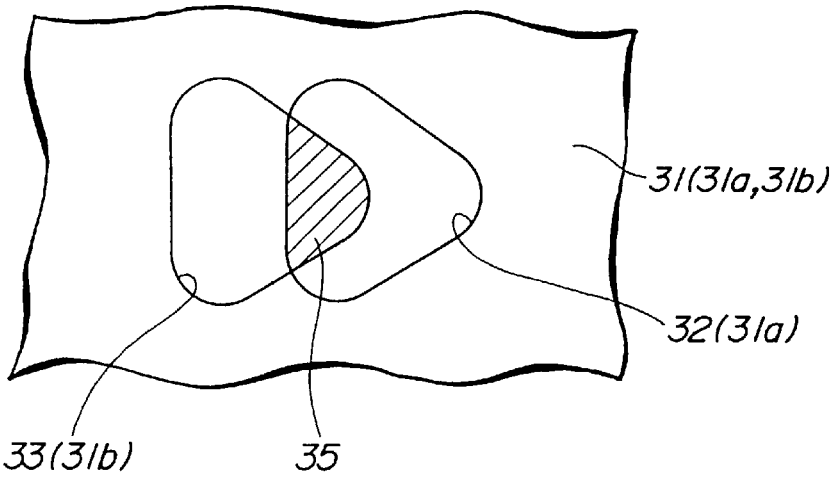
FIG. 1 shows an enlarged view of overlapped openings formed by the apparatus of the invention.

As seen in FIG. 1, a plurality of small pierce holes 32 are to be provided in a first layer of lining material 31 while corresponding small holes 33 are formed in an inner lining material 31*a*. According to provision of the small holes 32 and 33, an overlap area 35 is defined.

Figure 2A:
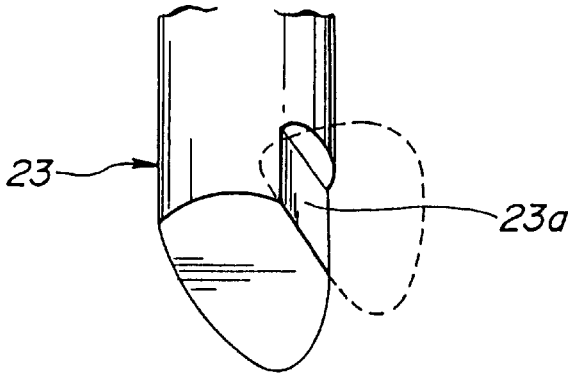
FIG. 2(*a*) is a perspective view of an upper piercing member.
Figure 2B:
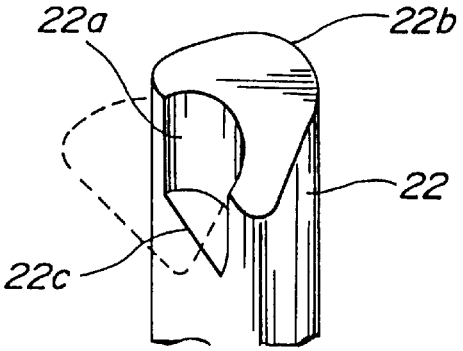

Referring to FIGS. 1, 2(*a*) and 2(*b*), the small holes 32 are made by a lower piercing member 22 mounted on the lower piercing stand 12 while the small holes 33 are made by an upper piercing member 23 mounted on the upper piercing stand 23. As may be seen in the drawings, the lower and upper piercing members 22, 23 are rigidly affixed to the lower and upper piercing stands 12, 13 so as to be in partial vertical alignment. The piercing members 22, 23 project toward each other and are aligned so as to overlap at an area thereof corresponding to the overlap area 35 of the small holes 32 and 33.

For forming the overlap portion 35 defined by the common area of the small holes 32 and 33, the lower piercing member 22 is provided with a vertically elongate convex groove 22*a* which matingly engages a cut out portion 23*a* of the upper piercing member 23, according to operational movement of the piercing apparatus 11.

An area of overlap of the lower and upper piercing members 22, 23 is indicated by arrows between two dashed lines in FIG. 3. This area of overlap defines the area of a lining material 31 (31*a*) which will become the overlap area 35 upon completion of piercing operation.

Figure 4:
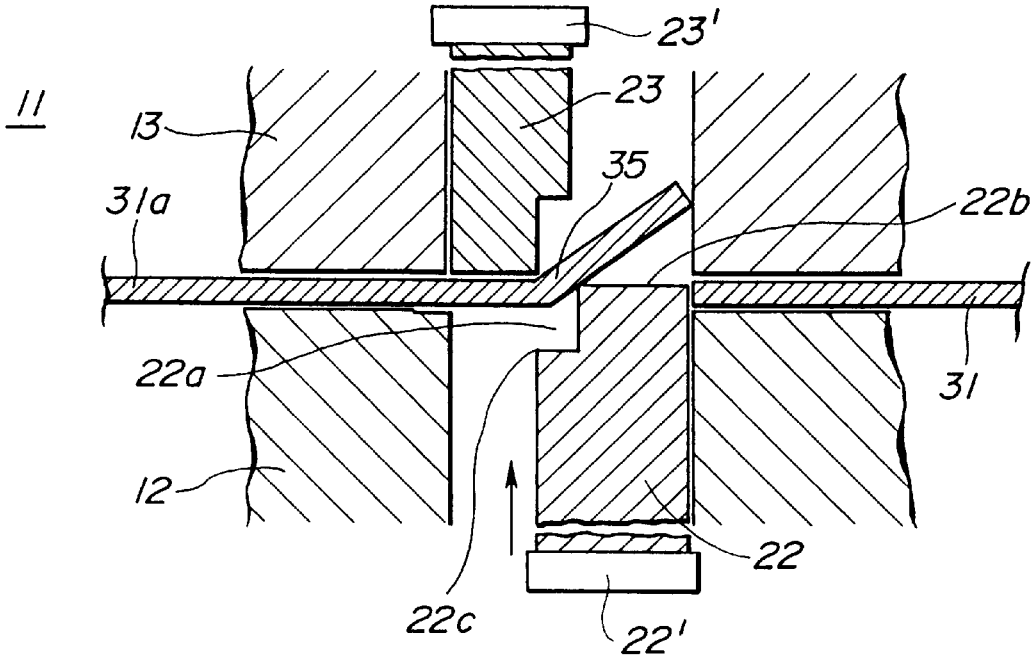
FIG. 4 shows the material arranged in the apparatus of FIG. 3 during piercing operation.

As may be appreciated from FIGS. 3–5, first the upper piercing stand 13 is moved downwardly over the lower piercing stand 12 to position the lining material 31 therebetween. Then, as seen in FIG. 4, the lower piercing member 22 is moved upwardly toward the upper piercing member 23, causing a leading edge 22*b* of the lower piercing member to puncture the lining material 31 (31*a*) while the concave groove 22*a* of the piercing member 22 assures that the edge 22*d* of the piercing member 22 does not puncture the overlap portion 35 of the small hole 32 at this time. Next, in FIG. 5 it may be seen that, with continued upward travel of the lower piercing member 22, the trailing edge 22*c* at a lower side of the concave groove 22*a* of the piercing member 22 slides adjacent the edge 23*c* of the upper piercing member 23 to cut out the portion of the small hole 32 which defines the overlap area 35.

The elongate concave groove 22*a* of the lower piercing member is matingly received by the cut out portion 23*a* of the upper piercing member 23, after which the lower piercing member 22 may be lowered and withdrawn from the lining material 31 to complete the piercing operation. According to this, the shape and position of the overlap area 35 is not distorted while a portion of the lining material 31 which is removed according to forming of the small hole 32 is completely detached from the lining material 31 (31*a*).

For forming the small hole 33 in lining material 31*b*, the above operation in inverted. That is, after the upper piercing stand 13 is moved downwardly over the lower piercing stand 12 to position the lining material 31*a* therebetween, the upper piercing member 23 is active to move downwardly toward the lower piercing member 22 in an operation inverse to that of FIGS. 3–5, causing a leading edge 23*b* of the lower piercing member to puncture the lining material 31*a* while a cut out area 23*a* (not shown) of the piercing member 23 assures that the edge 23*d* of the piercing member 23 does not puncture the overlap portion 35 of the small hole 33 at this time. As in the previous operation, with continued downward travel of the upper piercing member 23, the trailing edge 23*c* at a lower side of the cut out portion 23*a* of the piercing member 23 slides adjacent the edge 22*c* of the lower piercing member 22 to cut out the portion of the small hole 33 which defines the overlap area 35. In this operation, too, the elongate concave groove 22*a* of the lower piercing member is matingly received by the cut out portion 23*a* of the downwardly extended upper piercing member 23.

Thus, according to provision of the concave groove 22*a* and the cut out portion 23*a* of the lower and upper piercing members 22 and 23 respectively, collision, or bending of the piercing members and/or distortion and misalignment of the overlap area 35 may be reliably avoided and smooth, high speed operation of the piercing apparatus may be assured.

According to the above-described structure of a piercing apparatus according to the invention, an overall size of the apparatus may be kept small while a substantially higher operational speed is obtained. In addition, an accuracy of positioning and formation of the small overlapped holes formed by the piercing apparatus is greatly enhanced.

Further, the structure of the invention is not limited to the arrangement set forth above, but may be embodied in various ways without departing from the inventive concept. For example, the upper and lower piercing members may be mounted so as to be moveable in respective directions according to whether the small holes 32 or the small holes 33 are to be formed. Alternatively, the invention may be embodied such that, when the small holes 32 are to be formed, the piercing arrangement is set such that the piercing member 22 is mounted on the lower stand 12 while the piercing member 23 is mounted on the upper stand 13 and, when the small holes 33 are to be formed, the arrangement is inverted such that the piercing member 23 is mounted to the lower stand 12 while the piercing member 22 is mounted to the upper stand 13.

Further, although according to the above described embodiment, the piercing members 22 and 23 are respectively mounted to be flush with the surfaces of their stands 12 and 13, the piercing members 22, 23 may alternatively be mounted so as to project slightly from the surfaces of their respective stands 12, 13.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A piercing apparatus comprising:

an upper piercing stand supporting an upper piercing member having a first cross-section with a cut-out portion defining a first axially aligned overlap area;

a first driving mechanism connected to the upper piercing member;

a lower piercing stand supporting a lower piercing member having a second cross-section with a convex groove defining a second axially aligned overlap area;

a second driving mechanism connected to the lower piercing member;

wherein said upper piercing stand is movable relative to said lower piercing stand and said lower piercing stand is movable relative to said upper to piercing stand.

2. A piercing apparatus as claimed in claim 1, wherein said cut-out portion and said convex groove are mated as said upper piercing member and said lower piercing member are moved toward each other.

3. A piercing apparatus as claimed in claim 1, wherein said piercing apparatus pierces a first hole in a first layer of said lining and a second hole in a second layer of said lining, and an overlap of predetermined shape is defined between said first hole and said second hole.

4. A piercing apparatus as claimed in claim 3, wherein said cut-out portion has a facing end with a leading edge and a trailing edge; and said convex groove has a facing end with a leading edge and a trailing edge;

wherein upon movement of said upper piercing member and said lower piercing member to a relative position, said leading edge of the facing end of the cut-out portion engages said trailing edge of the groove and said leading edge of the facing end of the groove engages said trailing edge of the cut-out portion, thereby forming one of said first hole and said second hole, and removing a portion of said lining.

5. A piercing apparatus as claimed in claim 3, wherein said lower piercing member defines a shape of said first hole and said upper piercing member defines a shape of said second hole.

6. A piercing apparatus as claimed in claim 3, wherein said first layer and said second layer are positioned between said upper piercing stand and said lower piercing stand.

7. A piercing apparatus as claimed in claim 3, wherein said upper piercing member is driven along a piercing axis, and forms said first hole in said first layer, and said lower piercing member is driven along said piercing axis, and forms said second hole in said second layer.

8. A piercing apparatus as claimed in claim 1, wherein said lower piercing stand is driven and forms said first hole in said first layer of said lining.

9. A piercing apparatus as claimed in claim 8, wherein said upper piercing member is mounted on said lower piercing stand and said lower piercing member is mounted on said upper piercing stand, and said upper piercing member is driven and forms said second hole in said second layer of said lining.

* * * * *